US005291219A

United States Patent [19]

Ono et al.

[11] Patent Number: 5,291,219

[45] Date of Patent: Mar. 1, 1994

[54] THERMAL TRANSFER RECORDING APPARATUS HAVING PREHEATING

[75] Inventors: Takeshi Ono, Yokohama; Satoshi Wada, Kawasaki; Makoto Kobayashi, Tama; Takehiro Yoshida, Tokyo; Tomoyuki Takeda, Yokohama; Yasushi Ishida, Tokyo; Minoru Yokoyama, Yokohama; Akihiro Tomoda, Yokohama; Masakatsu Yamada, Yokohama; Takashi Awai, Yokohama, all of Japan

[73] Assignee: Canon Kabushiki Kaisha, Tokyo, Japan

[21] Appl. No.: 967,237

[22] Filed: Oct. 27, 1992

Related U.S. Application Data

[62] Division of Ser. No. 553,419, Jul. 17, 1990, Pat. No. 5,187,494.

[30] Foreign Application Priority Data

Jul. 19, 1989 [JP] Japan ..... 1-184413

[51] Int. Cl.[5] ..... B41J 2/38; B41J 2/325

[52] U.S. Cl. ..... 346/76 PH; 358/296

[58] Field of Search ..... 346/76 PH; 358/296; 400/128, 232

[56] References Cited

U.S. PATENT DOCUMENTS 4,558,963 12/1985 Applegate et al. ..... 400/120
4,560,993 12/1985 Hakoyama ..... 346/76 PH
4,568,817 2/1986 Leng et al. ..... 346/76 PH
4,636,810 1/1987 Asakura et al. ..... 346/76 PH
4,745,415 5/1988 Konda et al. ..... 346/105
4,814,789 3/1989 Ono ..... 346/76 PH
5,019,836 5/1991 Iwata et al. ..... 346/76 PH
5,187,494 2/1993 Ono et al. ..... 346/76 PH

FOREIGN PATENT DOCUMENTS 0295953 12/1988 European Pat. Off. .
0129196 7/1984 Japan .
0003969 1/1987 Japan .
0094360 4/1987 Japan .

*Primary Examiner*—Benjamin R. Fuller
*Assistant Examiner*—Huan Tran
*Attorney, Agent, or Firm*—Fitzpatrick, Cella, Harper & Scinto

[57] ABSTRACT

There is disclosed a thermal transfer printer for image recording by ink transfer from an ink sheet onto a recording sheet, capable of stable sheet transportation and improvement in image quality. The printer has transport mechanisms for the ink sheet and the recording sheet, a thermal head for heating the ink sheet, and a controller. If a next recording operation is instructed at the end of a preceding recording operation, the controller starts the transportation of the sheets and at the same time activates the thermal head with an energy smaller than in the ordinary image recording, thus effecting pre-heating of the thermal head, prior to the start of next recording operation.

4 Claims, 9 Drawing Sheets

S8
IMAGE RECORDING FOR ONE PAGE IS COMPLETED
YES
NO
S9
CUT RECORDING SHEET
S10
EXHAUST RECORDING SHEET
END
S11
INPUT PRINT COMMAND FOR NEXT LINE
NO
YES
S12
START TO CONVEY RECORDING SHEET 11 AND INK SHEET 14
HEAT PREVIOUS LINE
S13
OUTPUT LATCH SIGNAL 44
S14
1

THERMAL TRANSFER RECORDING APPARATUS HAVING PREHEATING

This application is a division of application Ser. No. 07/553,419 filed Jul. 17, 1990, now U.S. Pat. No. 5,187,494.

BACKGROUND OF THE INVENTION

1. Field of the Invention

The present invention relates to a thermal transfer recording method for recording an image on a recording medium by transferring ink from an ink sheet, and a recording apparatus utilizing such recording method.

Such thermal transfer recording apparatus may include a facsimile apparatus, an electronic typewriter, a copying apparatus, a printer or the like.

2. Related Background Art

In general, the thermal transfer printer employs an ink sheet containing thermofusible (or thermosublimable) ink coated on a substrate film, and achieves image recording by selectively heating this ink sheet with a thermal head corresponding to image signals, thereby transferring the fused (or subliming) ink onto a recording sheet. In such thermal transfer recording, the interval from the end of recording of a line to the start of recording of a next line may be extended. In such case, in order to prevent complete cooling of the thermal head, it is already conceived to effect so-called auxiliary recording, in which the thermal head is activated with the same recording data as in the preceding line but with an energy insufficient for transfer recording. Such conventional auxiliary recording will be explained further in the following, with reference to FIG. 7.

FIG. 7 shows the timing of image recording with a line thermal head, wherein T101–T103 indicate the timings of print commands for instructing the start of printing operation; T201–T203 indicate the start timings of transfer of the ink sheet and the recording sheet; 70 and 71 indicate pre-heating of the preceding line to be executed immediately before the actual recording; and 72–74 indicate the timings of actual image recording of one line each. The image recording 74 is conducted, without preheating, immediately after the image recording 73, as a print start command (timing T103) is entered in the course of said image recording 73.

L indicates the moving distance of the recording sheet and the ink sheet, and a curve 75 shows the moving state thereof as a function of time. The length of a recorded line is indicated by l. After the image recording 72 of a line, the preheating 71 with the data of said line is conducted prior to the next image recording 73, if the print command therefor is entered (timing T102) within a predetermined period of time after recording 72. This pre-heating is carried out to prevent the adhesion of the ink sheet and the recording sheet, resulting from solidification of the ink of the ink sheet when the thermal head is cooled.

After the completion of pre-heating 71, the transportation of the ink sheet and the recording sheet is started at the timing T202.

However, as indicated by an arrow 76, the ink sheet and the recording sheet scarcely move at the start of recording, and the transportation of the recording sheet by a line length l in fact takes place after a line recording time, corresponding to an arrow 77. Thus, in the conventionally conceived structure, though measures are taken for preventing the adhesion of the recording sheet and the ink sheet thereby improving the start characteristics of transportation of said sheets, the effect of such measures may not be fully exploited. Also there may result a gap (white streak) between the lines, because the image recording is already over when the recording sheet is transported by the line pitch l.

SUMMARY OF THE INVENTION

An object of the present invention is to provide a thermal transfer recording method capable of improving the image quality, and a recording apparatus utilizing this method.

Another object of the present invention is to provide a thermal transfer recording method capable, even if the ink sheet and the recording medium are mutually adhered, of effecting image recording after resolving such adhesion, and a recording apparatus utilizing such method.

Still another object of the present invention is to provide a thermal transfer recording method capable of reducing the running cost, and a recording apparatus utilizing such method.

Still another object of the present invention is to provide a thermal transfer recording method such that, if a next record start command is not entered by the end of image recording (for example image recording in intermittent manner depending on the data transfer rate or data decoding time as in facsimile), of starting the transportation of the recording medium and the ink sheet is started and the image recording is effected after first acting on the ink sheet with an energy smaller than in the ordinary image recording, thereby reducing the influence of adhesion of the recording medium and the ink sheet taking into account the delay in the start of transportation of the recording medium and the ink sheet.

DETAILED DESCRIPTION OF THE PREFERRED EMBODIMENTS

Now the present invention will be clarified in detial by preferred embodiments thereof shown in the attached drawings.

The embodiment explained in the following is featured by a fact that, if a next recording operation is not instructed at the end of an image recording operation on the recording medium by acting on the ink sheet, the start of transportation of the ink sheet and the recording medium is instructed at the start of the next recording operation, and the recording means is made to act on the ink sheet with an energy smaller than that used in ordinary image recording.

Description of facsimile apparatus (FIGS. 1-4)

Figure 1:
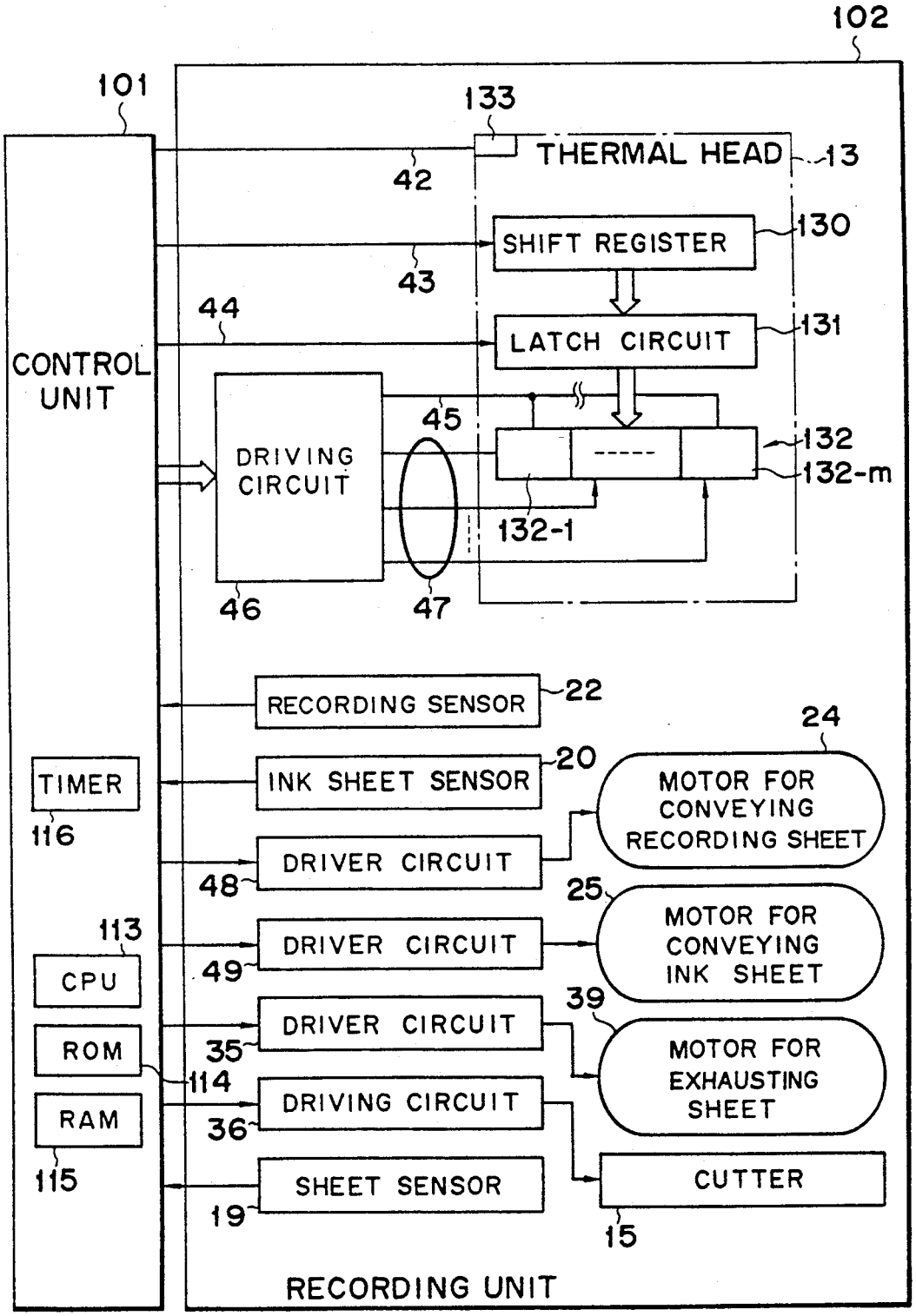
FIG. 1 is a block diagram showing electrical connections between a control unit and a recording unit of an embodiment of the present invention.
Figure 2:
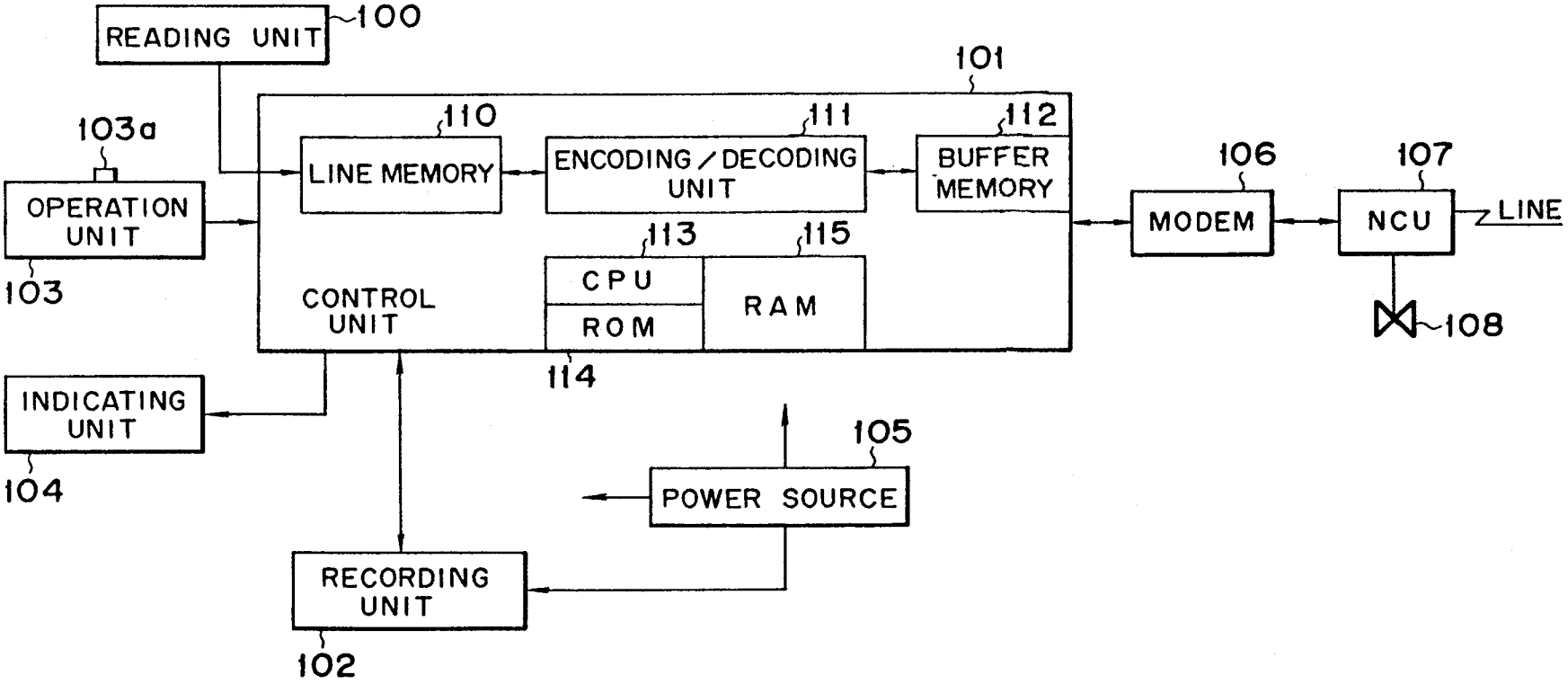
FIG. 2 is a schematic block diagram of a facsimile apparatus of this embodiment.
Figure 3A:
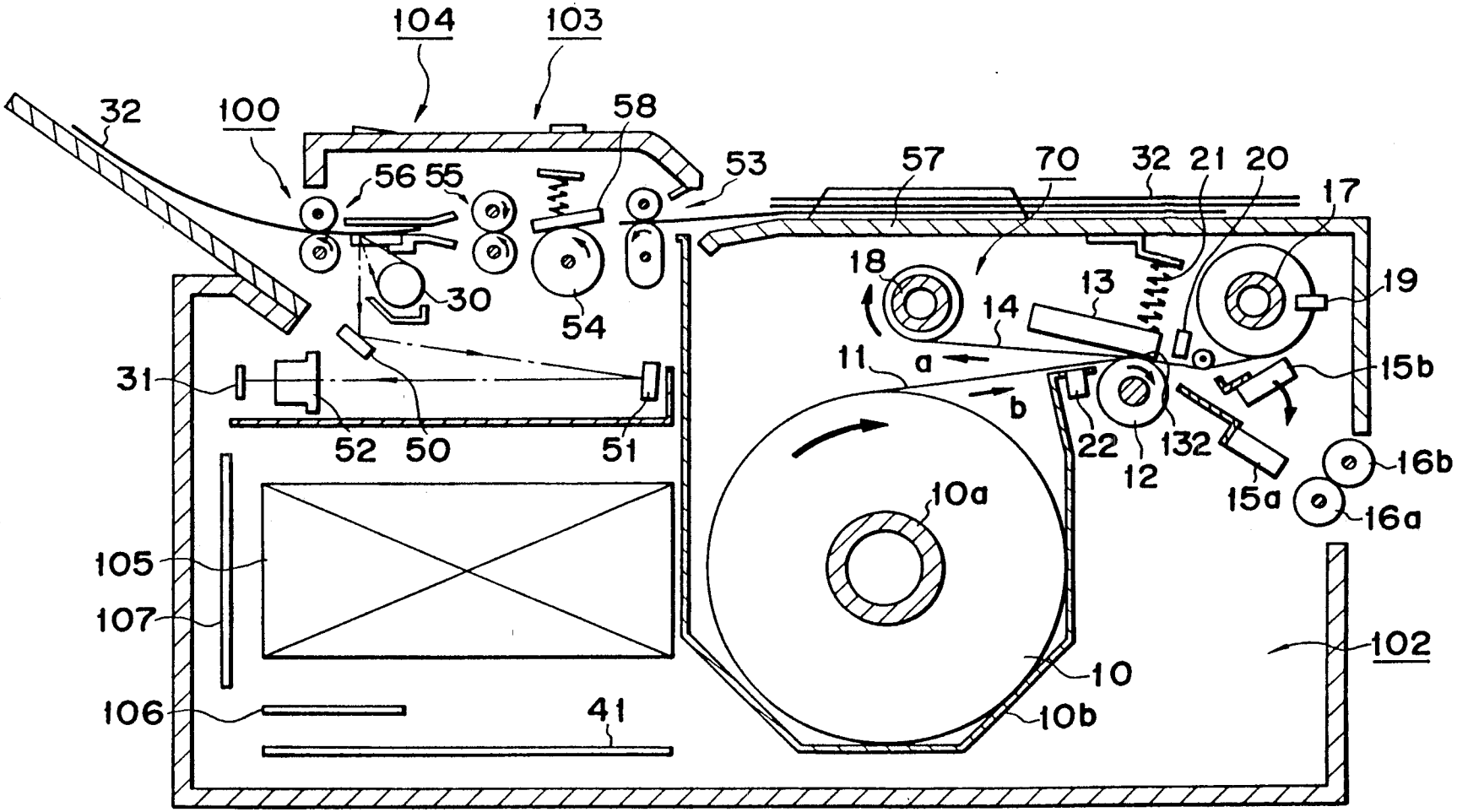
FIG. 3A is a lateral cross-sectional view of the structure of the facsimile apparatus of this embodiment.
Figure 3B:
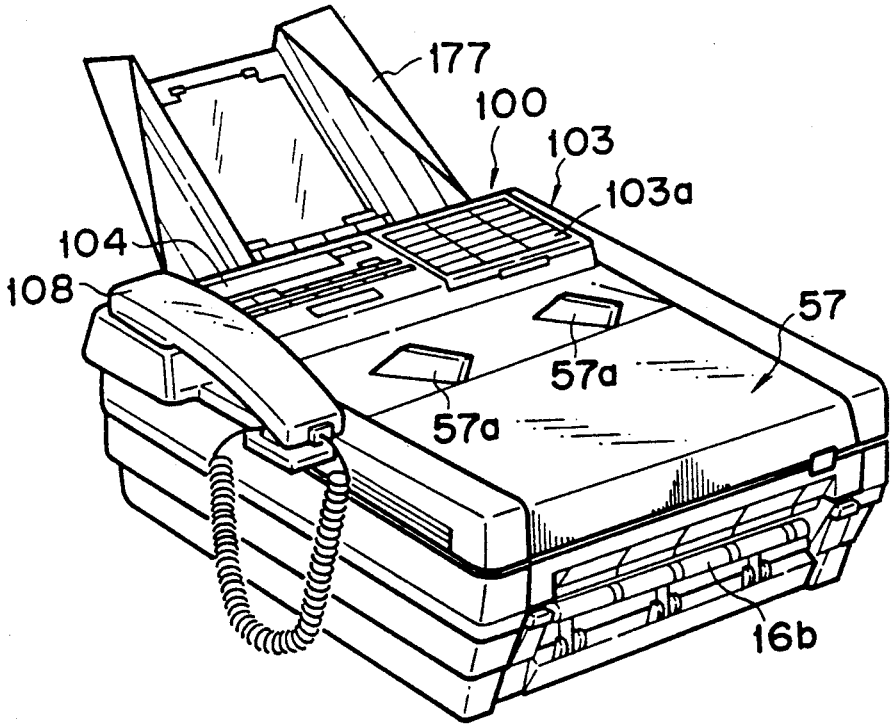
FIG. 3B is an external perspective view of this facsimile apparatus.
Figure 4:
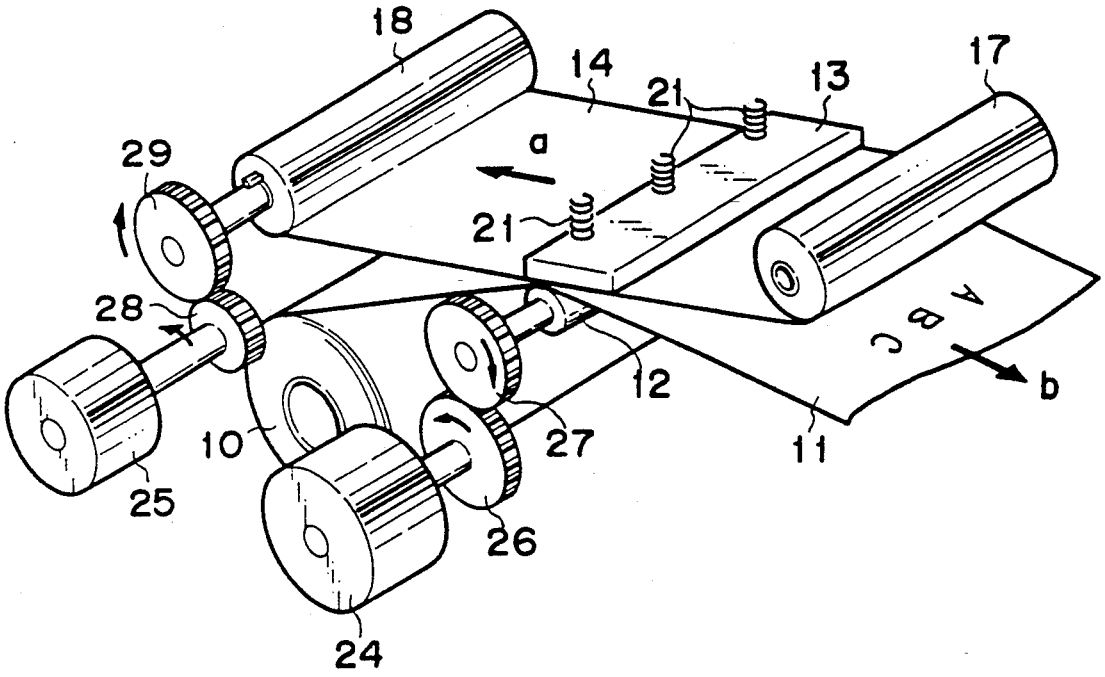
FIG. 4 is a perspective view showing a transport mechanism for the ink sheet and the recording sheet.

FIGS. 1 to 4 illustrate an embodiment of the present invention applied to a facsimile apparatus. FIG. 1 shows the electrical connections between a control unit 101 and a recording unit 102 of the facsimile apparatus; FIG. 2 is a schematic block diagram of the facsimile apparatus; FIG. 3A is a lateral cross-sectional view of the facsimile apparatus; FIG. 3B is an external perspective view thereof; and FIG. 4 is a perspective view of a transport mechanism for the recording sheet and the ink sheet.

At first reference is made to FIG. 2 to briefly explain the structure of the facsimile apparatus.

A reading unit 100 for photoelectrically reading an original image and sending the obtained digital image signal to the control unit 101 of the same apparatus (in case of copy mode) or another apparatus (in case of facsimile mode), is provided with an original transporting motor and an image sensor such as a CCD. The control unit 101 is constructed in the following manner. A line memory 110, for storing the image data of a line, serves to store the image data of a line received from the reading unit 100 in the case of facsimile mode or copy mode, or the received and decoded image data of a line in the case of reception of the image data. The data thus stored are supplied to the recording unit 102 for image formation. Also provided are an encoding/decoding unit 111 for encoding the image data to be transmitted, for example MH encoding, and decoding the received and encoded image data into the image data; and a buffer memory 112 for storing the encoded image data to be transmitted or received. These units of the control unit 101 are controlled by a CPU 113 composed for example of a microprocessor. In addition to the CPU 113, there are provided, in the control unit 101, a ROM 114 for storing control programs and various data for the CPU 113, and a RAM 115 for temporarily storing various data, as a work area of the CPU 113.

The recording unit 102 is provided with a thermal line head (having heat-generating elements over the recording width) for image recording using thermal transfer recording method onto the recording sheet. The structure of the recording unit will be explained in more detail later, with reference to FIG. 3. An operation unit 103 has various function keys such as a transmission start key, and numeral keys for entering telephone numbers. A switch 103*a*, for indicating the kind of the ink sheet 14 used, indicates a multi-print ink sheet or an ordinary one-time ink sheet when it is on or off, respectively. There are further provided a display unit 104 usually positioned next to the operation unit 103 for displaying the state of various functions and of the apparatus; a power supply unit 105 for supplying the entire apparatus with electric power; a modem 106 for modulation and demodulation of the transmitted or received signals; a network control unit (NCU) 107 for communication control for external lines; and a telephone set 108 with a telephone dial.

In the following the structure of the recording unit 102 will be explained in detail with reference to FIG. 3, in which the same components as those shown in FIG. 2 are represented by the same numbers.

A rolled sheet 10 is composed of plain recording paper 11 wound on a core 10*a*, and is rotatably loaded so as to feed the recording sheet 11 to the thermal head 13 by the rotation of a platen roller 12 in a direction indicated by the arrow. A loading unit 10*b* detachably holds the rolled sheet 10. The platen roller 12 advances the recording sheet 11 in a direction b, and presses the ink sheet 14 and the recording sheet 11 toward the heat-generating elements 132 of the thermal head 13. After image recording due to the heat generated in the thermal head 13, the recording sheet 11 is advanced, by further rotation of the platen roller 12, toward discharge rollers 16*a*, 16*b* and, upon completion of image recording of a page, is cut into a page length by the engagement of cutter members 15*a*, 15*b* and discharged.

There are also provided an ink sheet feed roll 17 composed of wound ink sheet 14, and an ink sheet takeup roll 18 which is driven by an ink sheet transporting motor to be explained later, thereby advancing the ink sheet 14 in a direction a. The feed roll 17 and takeup roll 18 are detachably loaded in an ink sheet loading part 70 of the apparatus. There are further provided a sensor 19 for detecting the remaining amount and the transport speed of the ink sheet 14; an ink sheet sensor 20 for detecting the presence or absence of the ink sheet 14; a spring 21 for pressing the thermal head 13 against the platen roller 12 across the recording sheet 11 and the ink sheet 14; and a recording sheet sensor 22 for detecting the presence or absence of the recording sheet.

In the following there will be explained the structure of the reading unit 100.

A light source 30 illuminates an original 32. The reflected light is transmitted, through an optical system composed of mirrors 50, 51 and a lens 52, to a CCD sensor 31 and is converted into an electrical signal. The original 32 is transported with a speed corresponding to the original reading speed, by means of transport rollers 53, 54, 55, 56 driven by an original transporting motor (not shown). An original stacker 57 can support plural originals 32, which are guided by a slider 57*a*, are separated one by one by the cooperation of the transport roller 54 and a separating member 58, transported to the reading unit 100 and finally discharged to a tray 177 after image reading.

A control circuit board 41, constituting the principal part of the control unit 101, serves to send various control signals to the various units of the apparatus. There are further provided a power supply unit 105, a modem circuit board unit 106, and a NCU circuit board unit 107.

FIG. 4 shows the details of the transport mechanism for the ink sheet 14 and the recording sheet 11.

There are shown a recording sheet transport motor 24 for driving the platen roller 12 thereby transporting the recording sheet 11 in a direction b which is opposite to the direction a; an ink sheet transport motor 25 for transporting the ink sheet 14 in the direction a; gears 26, 27 for transmitting the rotation of the recording sheet motor 24 to the platen roller 12; and gears 28, 29 for transmitting the rotation of the ink sheet motor 25 to the takeup roll 18.

As the recording sheet 11 and the ink sheet 14 are transported in mutually opposite directions, the direction of sequential image recording along the longitudinal direction of the recording sheet 11 (namely the direction a opposite to the transporting direction of the recording sheet 11) coincides with the transport direction of the ink sheet 14. If the ink sheet 14 is a multi-print ink sheet allowing plural recording operation at a same position, there stands a relation $V_P = -nV_I$ between the transport speed $V_P$ of the recording sheet and that $V_I$ of the ink sheet 14, wherein the negative sign indicates that the transport directions of the recording sheet 11 and the ink sheet 14 are mutually opposite.

FIG. 1 shows the electrical connections between the control unit 101 and the recording unit 102 in the above-explained facsimile apparatus, wherein the same components as those in other drawings are represented by the same numbers.

The thermal head 13, composed of a line head, is provided with a shift register 130 for storing serial recording data of a line received from the control unit 101 and shift clock signals 43; a latch circuit 131 for latching the data of the shift register 130 in response to a latch signal 44; and heat-generating elements 132 consisting of heat-generating resistors of a line. The resistors 132 are driven in a divided manner in m blocks 132-1–132-m. A temperature sensor 133 is mounted on the thermal head 13 for detecting the temperature thereof. The output signal 42 of the temperature sensor 133 is A/D-converted in the control unit 101 and supplied to the CPU 113. In response the CPU 113 detects the temperature of the thermal head 13, and accordingly regulates the energy supplied to the thermal head depending on the characteristics of the ink sheet 14, for example by varying the pulse duration of a strobe signal 47 or the driving voltage for the thermal head 13. A programmable timer 116 set at a time instructed by the CPU 113, starts time measurement in response to an instruction therefor, and releases an interruption signal or a time-out signal at predetermined times.

The type (characteristics) of the ink sheet 14 is indicated by the manual operation by the operator of the switch 103*a* of the operation unit 103. It may also be automatically distinguished by the detection of a mark printed on the ink sheet 14, or of a mark, a notch or a projection provided on the cartridge of the ink sheet.

A driving circuit 46 receives a drive signal for the thermal head 13 from the control unit 101, and releases a strobe signal 47 for driving each block of the thermal head 13. The driving circuit 46 is capable of varying the energy supplied to the thermal head 13 by varying the voltage supplied to a power supply line 45 for current supply to the heat-generating elements 132 of the thermal head 13, in response to an instruction from the control unit 101. A driving circuit 36 is provided for causing the engagement of the cutter members 15, along with a cutter driving motor etc. A sheet discharging motor 39 is provided for rotating the discharge rollers 16. Driver circuits 35, 31, 32 are provided respectively for driving the discharge motor 39, recording sheet motor 24 and ink sheet motor 25. These motors 39, 24, 25 are composed of stepping motors in the present embodiment, but they may be, for example DC motors.

Recording operation (FIGS. 1–6)

Figure 5A:
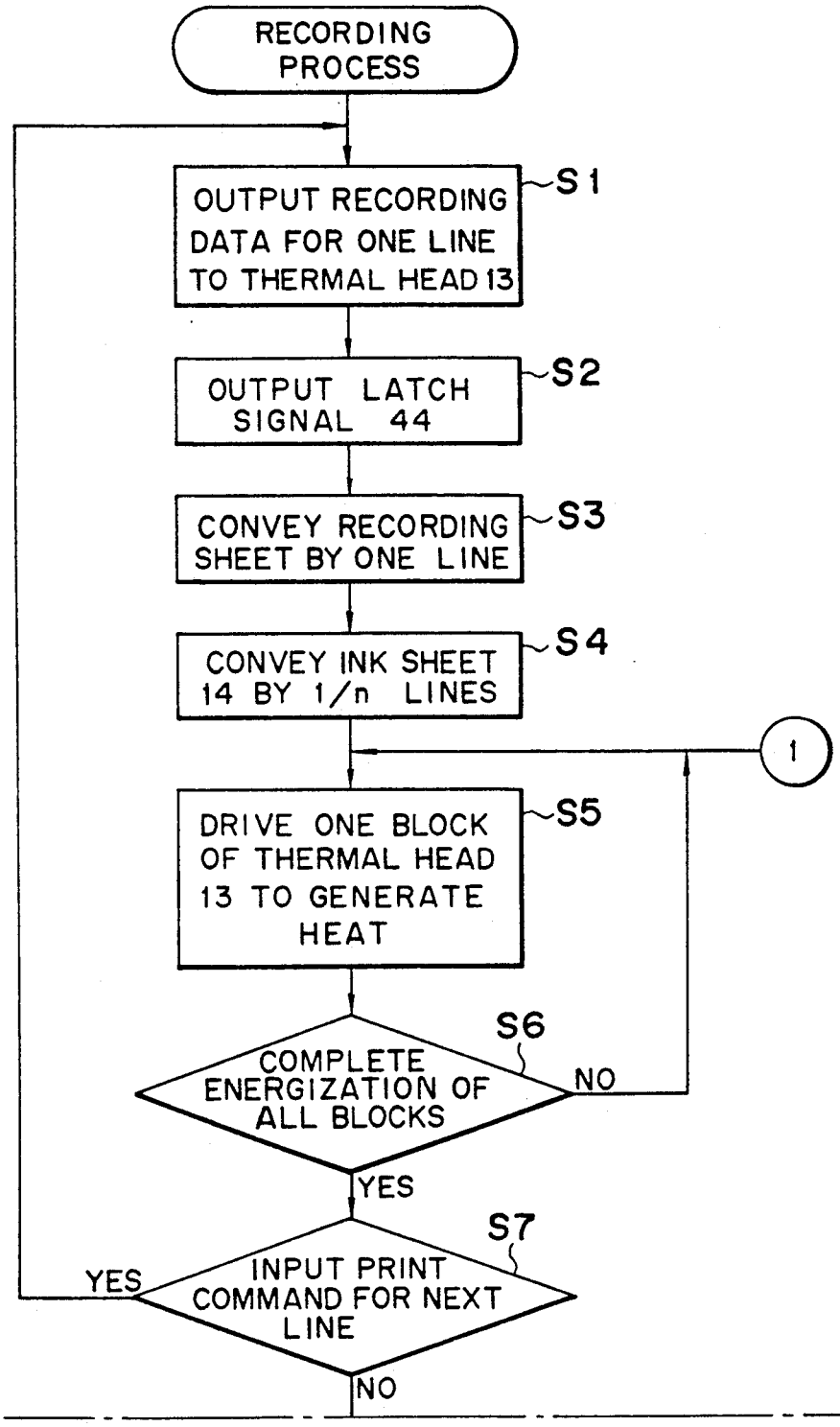
FIG. 5 is a flow chart showing the recording sequence in the facsimile apparatus.
Figure 5A:
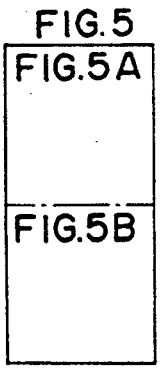
Figure 5B:
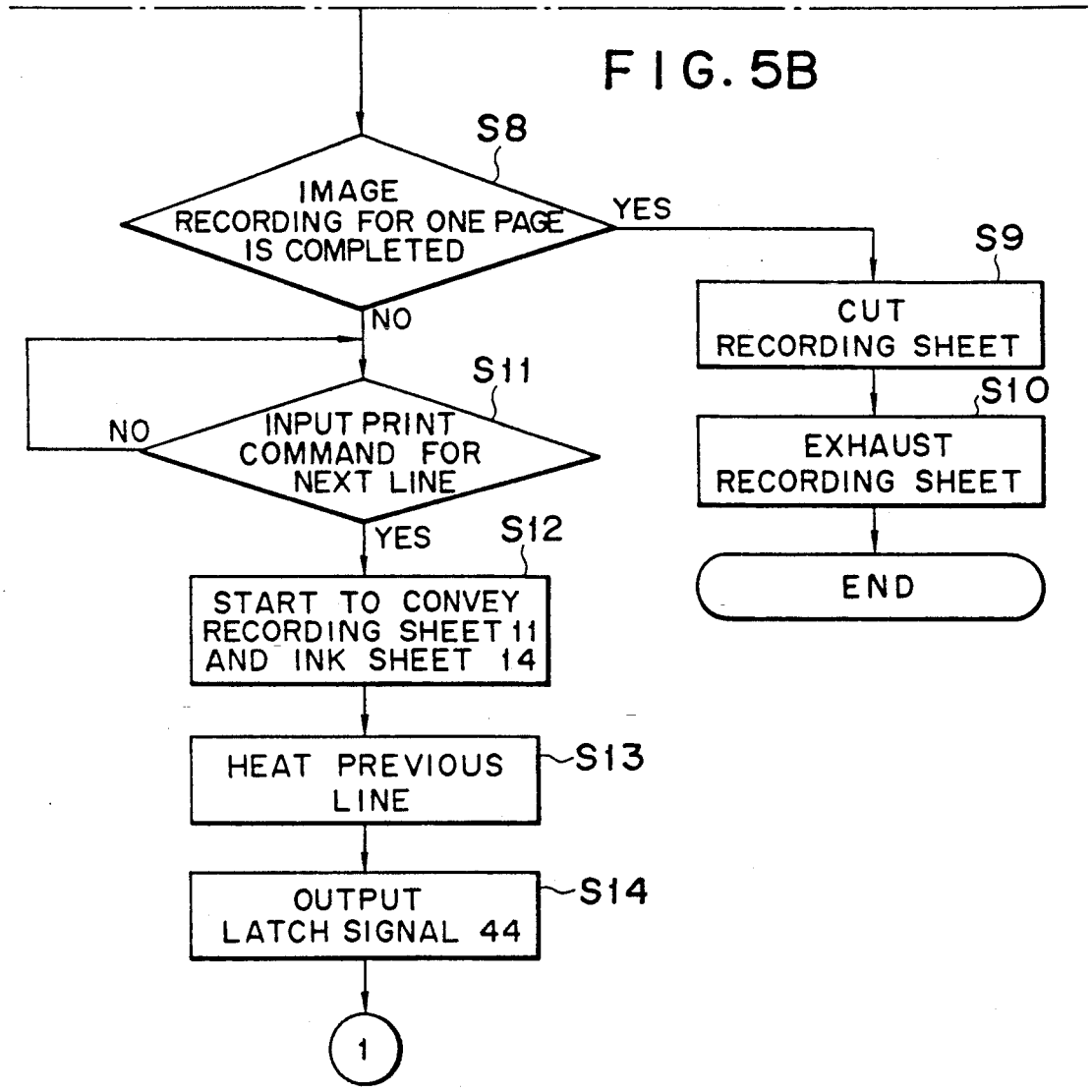

FIG. 5 is a flow chart showing a recording sequence of a page in the facsimile apparatus of the present embodiment, and a corresponding control program is stored in the ROM 101 of the control unit 101.

This sequence is started when the image data of a line to be recorded are stored in the line memory 110 whereby the recording operation is enabled. At first a step S1 serially stores the recording data of a line in the shift register 130. Upon completion of the data transfer, a step S2 releases the latch signal 44, thereby storing the recording data of a line in the latch circuit 131.

A next step S3 transports the recording sheet 11 by a line. The line length corresponds to the length of a dot recorded by the thermal head 13. A next step S4 drives the ink sheet motor 25, thereby transporting the ink sheet 14 by a length of 1/n of a line, wherein n is for example 4. Transportation of the recording sheet 11 by a line requires a step in the recording sheet motor 24, while that of the ink sheet 14 by a line requires 4 steps (in case of n=4) of the ink sheet motor 25. This is achieved by taking the ratio of minimum stepping angles of the recording sheet motor 24 and the ink sheet motor 25 as 4:1, or taking a 4:1 ratio between the ratio of the gears 26, 27 and that of the gears 28, 29.

Then a step S5 energizes one of the blocks of the heat-generating resistors 132 to record an image, and a step S6 discriminates whether the energizations of all the blocks of the thermal head 13 have been completed. If not, the sequence returns to the step S5 to effect the energization of the next block. Upon completion of recording of a line, the sequence proceeds from the step S6 to a step S7 for discriminating whether a print command for the next line has been entered. If entered, the sequence returns to the step S1 to effect the image recording of the next line. In the present embodiment, the energizing time of each block of the thermal head is about 0.6 ms, and the time required for recording a line is about 2.5 ms. Though not shown in the flow chart, the recording data of the next line, if transferred, are stored in the shift register 130 of the thermal head 13.

On the other hand, if the step S7 identifies that the print command for the next line has not been entered, (for example when recording of one page is completed, or when the recording of lines is conducted in an intermittent manner, depending on the data transfer rate or the data decoding time, as in facsimile recording), the sequence proceeds to a step S8 for discriminating whether the recording of a page has been completed. If completed, a step S9 cuts the recording sheet 11 into a page length by cutter members 15. Then a step S10 transports the recorded sheet toward the discharge rollers 16 and discharges it from the apparatus.

On the other hand, if the step S8 determines that the recording of a page has not been completed, the sequence proceeds to a step S11 to discriminate whether the print command for a next line has been entered. The step S11 awaits the entry of the record start command for the next line, and, upon entry of this command, a step S12 starts the transportation of the recording sheet 11 and the ink sheet 14. Also a step S13 effects pre-heating by energizing the thermal head with image data which are the same as those in the preceding line. This pre-heating is conducted with energy that is insufficient for image recording, and for an energizing time shorter than in the normal image recording, for example about 0.1–0.3 ms in the present embodiment. Then a step S14 releases the latch signal 44 to latch the image data of the next line, stored in the shift register 130, in the latch circuit 131, and the sequence returns to the step S5 for executing the image recording of the next line. The image data of the next line, latched from the shift register 130 into the latch circuit 131, have been serially transferred to the shift register 130 either in the course of image recording of the preceding line or in the course of waiting for the entry of the print command of the next line.

In the present embodiment, the pre-heating is always conducted if the record start command for the next line is not entered at the end of the recording of image data of the preceding line, but it is also possible to set a predetermined time in the timer 116 in the step S8, to discriminate whether the predetermined time has expired in the step S11 during which entry of the next print start command is awaited, and to effect the pre-heating with the recording data of the preceding line if this predetermined time (for example 10 ms in the present embodiment) has elapsed at the entry of the print start command of the next line. Also in the present embodiment the pre-heating is conducted with the recording data of the preceding line, but the present invention is not limited to such an embodiment. For example the pre-heating may be conducted with all black data of an energy insufficient for image recording.

Figure 6:
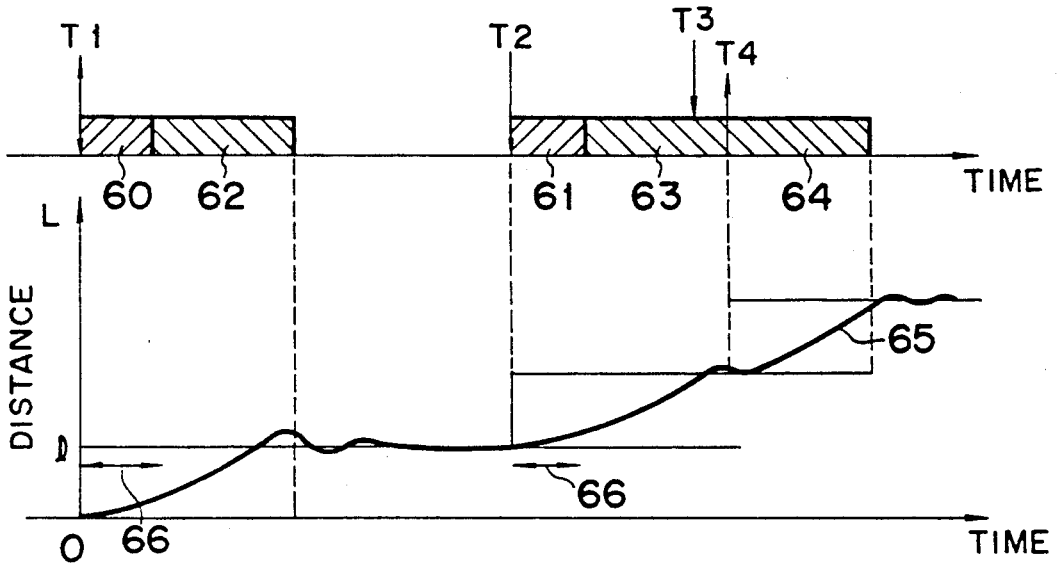
FIG. 6 is a timing chart showing the timing of main recording and pre-heating in the embodiment.
Figure 7:
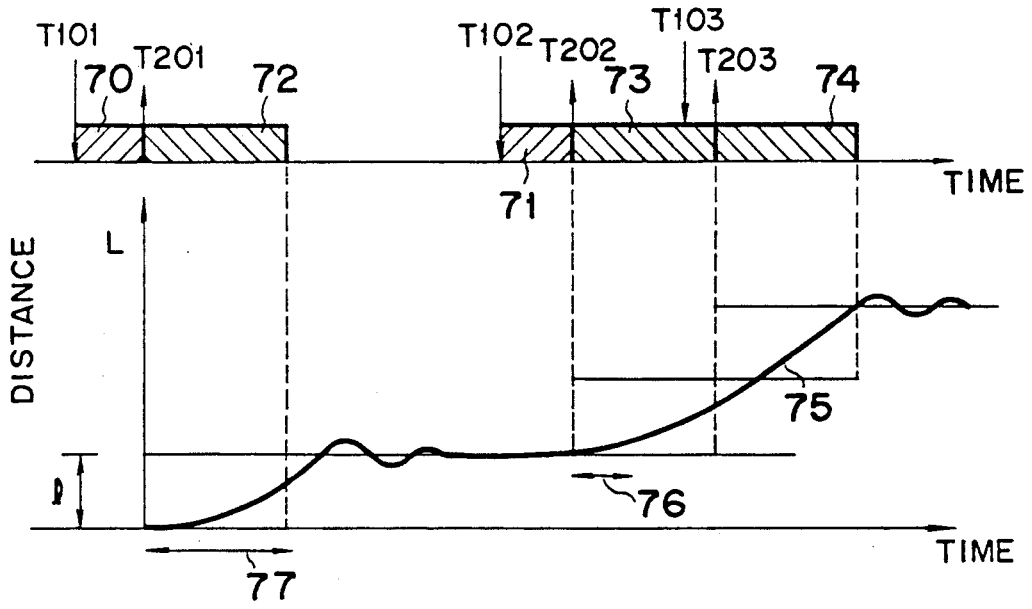
FIG. 7 is a timing chart showing the timing of conventionally conceived image recording.

FIG. 6 is a timing chart showing the timing of image recording in the facsimile apparatus of the present embodiment.

In FIG. 6, 62–64 indicate the image recording operations of different lines; T1, T2 and T4 indicate the start timings of recording operations of next lines; and T3 indicates the timing of entry of the print command L indicates the moving distance of the recording sheet 11 and the ink sheet 14, while l indicates the recording length of a line, and a curve 65 indicates the movement of the recording sheet 11 and the ink sheet 14 as a function of time.

At the start of image recording 62 or 63, the pre-heating with the recording data of the preceding line and the transportation of the recording sheet 11 and the ink sheet 14 are simultaneously started. Consequently the start of transportation of the recording sheet 11 and the ink sheet 14 is improved in comparison with the conventional structure, and, in a period 66 in which the recording sheet and the ink sheet have scarcely moved, there is conducted the pre-heating 60 or 61. Thus the image recording of the next line is conducted after the ink sheet 14 and the recording sheet 11 actually begin moving, and the image recording of a line is completed when the recording sheet has been transported by a line length l. The recorded image is not affected by the pre-heating as it is practically conducted on the recorded data of the preceding line. Also since the image recording is conducted approximately over the entire width l of each line, it is possible to prevent the formation of a white streak between the lines, and thus to improve the quality of the recorded image.

Figure 8:
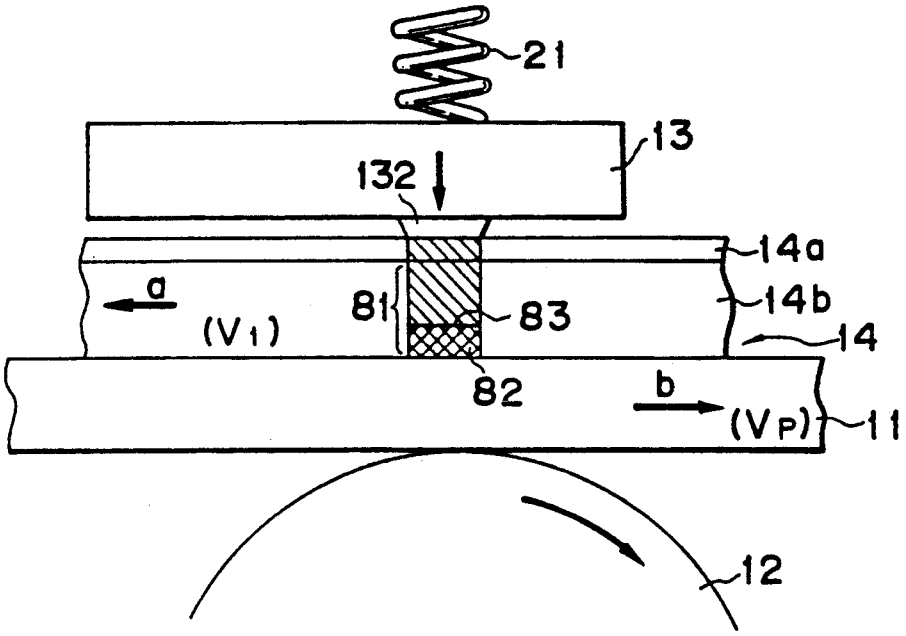
FIG. 8 is a view showing the structure of the ink sheet and the state thereof and of the recording sheet at image recording.

Recording principle (FIG. 8)

FIG. 8 shows the state of image recording in the present embodiment, in which the recording sheet 11 and the ink sheet 14 are transported in mutually opposite directions.

The recording sheet 11 and the ink sheet 14 are pinched between the platen roller 12 and the thermal head 13, which is pressed to the platen roller with a predetermined pressure exerted by the spring 21. The recording sheet 11 is transported by the rotation of the platen roller 12 in a direction b with a speed $V_P$, while the ink sheet 14 is transported, by the rotation of the ink sheet motor 25, in a direction a with a speed $V_I$.

Energization of the heat-generating resistor 132 of the thermal head 13 heats a hatched portion 81 of the ink sheet 14. **14*a* indidates the substrate film of the ink sheet 14, and 14*b* indicates the ink layer thereof. The ink of thus heated ink layer 81 is fused, and a part 82 is transferred onto the recording sheet 11. The transferred part 82 corresponds approximately to 1/n of the ink layer 81**.

At the transfer, it is necessary to apply a shearing force to the ink at a boundary 83 of the ink layer **14*b*, thereby transferring only the ink layer portion 82 to the recording sheet 11. The shearing force require depends on the temperature of the ink layer, and becomes smaller as the temperature of the ink layer becomes higher. Thus, since the shearing force in the ink layer increases when the heating time of the ink sheet 14 is shortened, it is possible to securely peel the ink layer to be transferred from the ink sheet 14, by increasing the relative speed between the ink sheet 14 and the recording sheet 11**.

In the present embodiment, the recording sheet 11 and the ink sheet 14 are transported in mutually opposite directions in the course of recording, but the present invention is likewise applicable to a case in which said sheets are transported in a same direction at image recording.

Figure 9:
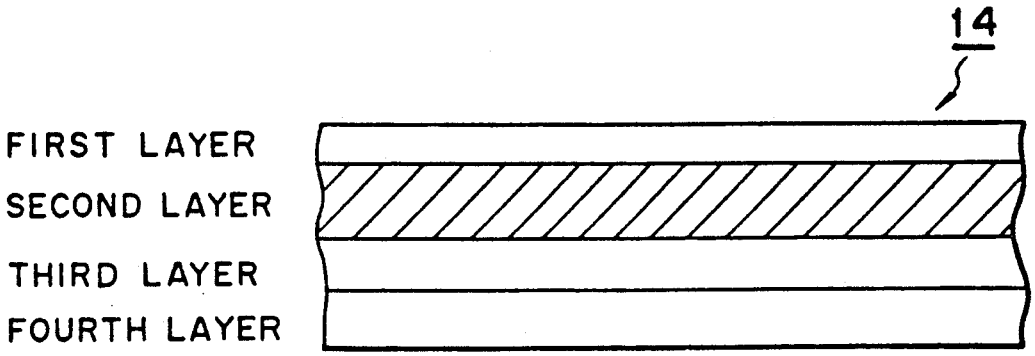
FIG. 9 is a cross-sectional view of the ink sheet employed in the embodiment.

Description of ink sheet (FIG. 9)

FIG. 9 is a cross-sectional view of a multi-print ink sheet composed of four layers employed in the present embodiment in this case.

A second layer is a substrate film for the ink sheet 14. In case of multi-print ink sheet, since a same position is subjected to thermal energy plural times, the substrate film is preferably composed of aromatic polyamide film or condenser paper of high thermal resistance, but conventional polyester film may also be used for the purpose. The substrate film is preferably as thin as possible in terms of print quality, but is desirably selected in a range of 3 to 8 μm in consideration of the mechanical strength.

A third layer is the ink layer containing ink in an amount sufficient for effecting n transfers onto the recording sheet. The ink is principally composed of an adhesive material such as EVA resin, a coloring material such as carbon black or nigrosine dye, and a binding material such as carnauba wax or paraffin wax, in such a manner as to allow uses of n times in a same place. The coating amount of said ink is preferably in a range of 4–8 $g/cm^2$, but can be arbitrarily selected as the sensitivity and the image density vary depending on the coating amount.

A fourth layer is a top coating layer for preventing ink transfer by pressure in non-printed areas, and is composed for example of transparent wax. Thus the transfer by pressure takes place only in the transparent fourth layer, whereby the background smudge of the recording sheet can be prevented. A first layer is a heat resistant coating, for protecting the substrate film of the second layer from the heat of the thermal head 13. Such heat resistant coating is preferable for the multi-print ink sheet which may receive thermal energy of n lines in a same position (in case of continued black information), but the use of said coating can be arbitrarily selected. Such a coating is particularly effective for a substrate film of relatively low thermal resistance, such as polyester film.

The structure of the ink sheet 14 is not limited to the present embodiment. For example, the ink sheet may be composed of a substrate layer and a porous ink containing layer provided on a face of the substrate layer and containing ink therein, or having a heat resistant ink layer of fine porous network structure formed on a substrate film and containing ink therein. The substrate may be composed of a film for example of polyamide, polyethylene, polyester, polyvinyl chloride, triacetyl cellulose, nylon, or of paper. The heat resistant coating, which is not indispensable, may be composed for example of silicone resin, epoxy resin, fluorinated resin or nitrocellulose.

Ink sheets having thermo-sublimable ink can be composed, for example, of a substrate of polyethylene terephthalate, polyethylene naphthalate or aromatic polyamide, and a layer of coloring material containing a dye and spacer particles composed of guanamine resin and fluorinated resin.

Heating in a thermal transfer printer is not limited by the thermal head explained above, but can also be achieved by direct current supply into the ink layer or by laser irradiation.

Also the foregoing embodiment employs a thermal line head, but the present invention is also applicable to a so-called serial thermal transfer printer. Furthermore the foregoing embodiment has been explained with the recording process utilizing a multi-print ink sheet, but there may likewise be employed a one-time ink sheet.

Also the thermal transfer printer is applied to a facsimile apparatus in the foregoing embodiment, but the thermal transfer recording apparatus of the present invention is also applicable to a word processor, an electronic typewriter, a copying apparatus or the like.

Furthermore the recording medium is not limited to paper but can also be cloth or plastic sheet as long as ink transfer is possible. Furthermore, the ink sheet is not limited to the roll structure shown in the embodiment, but can also be of the so-called ink sheet cassette structure incorporating ink sheets and detachably loadable in the recording apparatus.

Furthermore the energy adjustment at the pre-heating may be achieved not only by variation of the pulse duration but also by variation in the applied voltage.

As explained in the foregoing, the embodiment explained above enables effective pre-heating taking the start characteristics of transportation of the recording sheet and the ink sheet into consideration. Also there can be achieved stable running of the recording sheet and the ink sheet, and improved recording quality, by starting the transportation of the recording sheet and the ink sheet after the ink of the ink sheet is fused. Also there can be reduced the noise or vibration resulting from adhesion of the ink sheet and the recording sheet.

The recording method of the present invention is particularly effective in the multi-print recording method in which the ink sheet is moved by 1/n of the moving amount of the recording sheet, since a shearing force has to be generated between the ink sheet and the recording sheet.

Furthermore, the image recording with pre-heating as explained in the foregoing embodiment is particularly effective in a facsimile apparatus or the like in which the interval between the recordings of successive lines may not be constant and may become extended.

As explained in the foregoing, if a start command for next recording is not entered before the end of recording, the present invention starts transportation of the recording medium and the ink sheet and acts on the ink sheet with an energy smaller than in the ordinary image recording prior to starting the actual image recording, thereby reducing the influence of adhesion between the recording medium and ink sheet and improving the recording quality, taking into consideration the delay in the start of transportation of the recording medium and the ink sheet.

What is claimed is:

1. A recording apparatus for recording an image on a recording medium by transferring an ink from a member for containing ink therein, said apparatus comprising:

moving means for moving said member and said recording medium relatively;

heat generator for effecting said member thereby recording an image on said recording medium; and control means adapted, prior to a start of a next recording operation by said heat generator, to instruct said moving means to start movement and said heat generator to effect said member with an energy smaller than in an ordinary recording operation, and thereafter causing said heat generator to start the next recording operation, said smaller energy being effected while said recording medium and said member are moved, wherein the next recording operation is performed after a relative speed between the member for containing ink and the recording medium exceeds a predetermined value.

2. An apparatus according to claim 1, further comprising communication means for communication with an external device.

3. An apparatus according to claim 1, further comprising:

reading means for reading an original image to obtain an original image data; and transfer means for receiving and transmitting said original image data.

4. A method of recording an image on a recording medium by transferring an ink from a member for containing ink therein, comprising the steps of:

providing a heat generator for effecting said member thereby recording an image on said recording medium;

moving said member and said recording medium relatively;

preheating, when said member and said recording medium are relatively moved, prior to a start of a next recording operation, and causing said heat generator to effect said member with an energy smaller than in an ordinary recording operation, and thereafter causing said heat generator to start the next recording operation, said smaller energy being effected while said recording medium and said member are moved; and recording after a relative speed between the member for containing ink and the recording medium exceeds a predetermined value.

* * * * *

UNITED STATES PATENT AND TRADEMARK OFFICE

CERTIFICATE OF CORRECTION

PATENT NO. : 5,291,219

DATED : March 1, 1994

INVENTOR(S) : TAKESHI ONO, ET AL.

It is certified that error appears in the above-identified patent and that said Letters Patent is hereby corrected as shown below:

COLUMN 2

Line 3, "Also there may" should read --Also,--.
Line 4, "result" should be deleted and "between" should read --may still be formed between--.
Line 64, "detial" should read --detail--.

COLUMN 5

Line 4, "operation" should read --operations--.
Line 59, "be," should read --also be,-- and "example" should read --example,--.
Line 64, "ROM 101" should read --ROM 114--.

COLUMN 7

Line 24, "command L" should read --command. L--.

COLUMN 8

Line 65, "having" should read --of--.
Line 66, "of" should read --having a--.

UNITED STATES PATENT AND TRADEMARK OFFICE

CERTIFICATE OF CORRECTION

PATENT NO. : 5,291,219

DATED : March 1, 1994

INVENTOR(S) : TAKESHI ONO, ET AL.

It is certified that error appears in the above-identified patent and that said Letters Patent is hereby corrected as shown below:

COLUMN 10

Line 16, "heat generator" should read --a heat generator--.

Signed and Sealed this

Ninth Day of August, 1994

Bruce Lehman

*Attest:*

BRUCE LEHMAN

*Attesting Officer*

*Commissioner of Patents and Trademarks*

--